United States Patent [19]

Kobayashi

[11] 4,253,370

[45] Mar. 3, 1981

[54] KEYBOARD MUSICAL INSTRUMENT

[75] Inventor: Eiji Kobayashi, Hamamatsu, Japan

[73] Assignee: Nippon Gakki Seizo Kabushiki Kaisha, Japan

[21] Appl. No.: 914,390

[22] Filed: Jun. 12, 1978

[30] Foreign Application Priority Data

Jun. 17, 1977 [JP] Japan ..... 52/71770
Aug. 5, 1977 [JP] Japan ..... 52/105042[U]
Aug. 5, 1977 [JP] Japan ..... 52/105043[U]

[51] Int. Cl.[3] ..... G10C 5/00; G10D 13/08

[52] U.S. Cl. ..... 84/198; 84/170; 84/404

[58] Field of Search ..... 84/403–405, 84/175, 198, 216, 225, 174, 170

[56] References Cited

U.S. PATENT DOCUMENTS 441,559 11/1890 Hirl ..... 84/175
677,860 7/1901 Deutsch ..... 84/170
747,966 12/1903 Gilmore ..... 84/170
3,761,598 9/1973 Haile ..... 84/404

FOREIGN PATENT DOCUMENTS 269315 8/1913 Fed. Rep. of Germany ..... 84/170
261 of 1907 United Kingdom ..... 84/170

*Primary Examiner*—Gene Z. Rubinson
*Assistant Examiner*—Shelley Wade
*Attorney, Agent, or Firm*—Ostrolenk, Faber, Gerb & Soffen

[57] ABSTRACT

In addition to the single combination of a tone generator such as a string with a hammer, a further combination is provided by an auxiliary tone generator such as an elongated thin metal strap and/or an auxiliary hammer preferably accompanied by a mechanism for effecting selective striking contact for tonal vibration between the tone generator or generators and the hammer or hammers when an associated common key is operated. Selectively combined simultaneous striking by the hammer or hammers generates tones of enriched tone color and volume by single key operation.

11 Claims, 22 Drawing Figures

Fig. 11
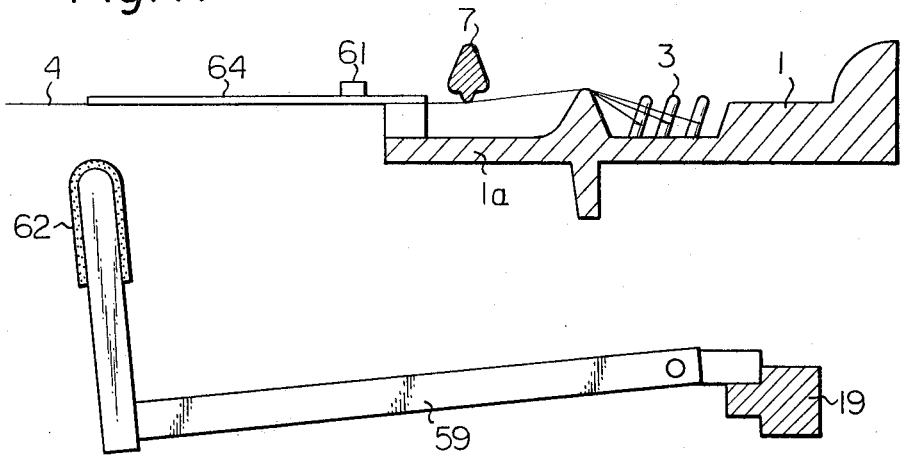
Fig. 12A
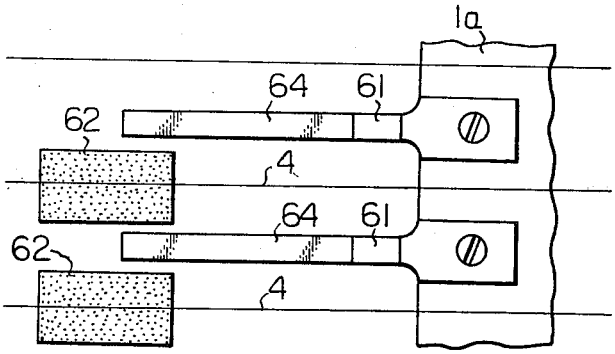
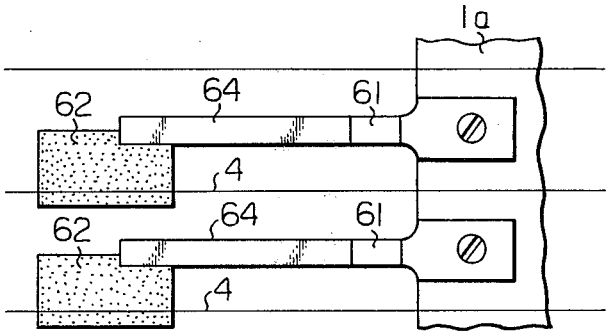
Fig. 12 B
Fig. 12 C
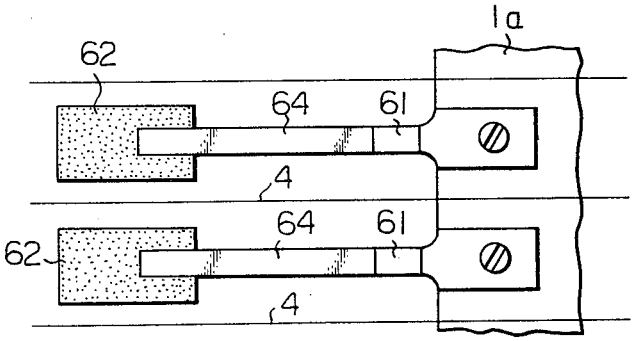

KEYBOARD MUSICAL INSTRUMENT

BACKGROUND OF THE INVENTION

The present invention relates to improved keyboard musical instrument, and more particularly relates to improvement in the tone generator striking mechanism for a keyboard musical instrument such as an electric piano.

In the construction of the conventional keyboard musical instrument such as the conventional electric piano, a number of tone generators such as strings are arranged in stretched state on a framework such as a piano frame and a single hammer is provided for each tone generator while being operationally coupled to an associated key via a hammer shank. Upon key operation, the hammer shank is driven for upward swinging and the hammer strikes the tone generator for tonal vibration.

In other words, a single tone is generated through striking contact between the single tone generator and the single hammer. With this single combination striking system, it is difficult to generate tones of a wide variety of tone colour and volume by single key operation and except for free selection in tone mode.

SUMMARY OF THE INVENTION

It is one object of the present invention to provide an improved keyboard musical instrument which enables generation of tones of a wide variety of tone colour and volume by operation on an associated common key.

It is the other object of the present invention to provide improved keyboard musical instrument which assures free selection in tone mode.

In the following description, the direction parallel to the running direction of the main tone generators such as the strings on the instrument will be referred to as the strings direction for the purpose of simplicity.

In accordance with one aspect of the present invention, two sets of tone generators, i.e. a main tone generator generally in the form of a stretched string and an auxiliary tone generator generally in the form of an elongated thin metal strap or a wire rod, are used in combination with two sets of hammers operationally related to an associated common key.

In accordance with another aspect of the present invention, two sets of tone generators, i.e. a main tone generator generally in the form of a stretched string and an auxiliary tone generator generally in the form of an elongated thin metal strap or a wire rod, are used in combination with one set of hammer operationally related to an associated common key.

In accordance with the other aspect of the present invention, one set of tone generator generally in the form of a stretched string is used in combination with two sets of hammer operationally related to an associated common key.

BRIEF DESCRIPTION OF THE DRAWINGS

FIG. 11 is a side view, partly in section, of the seventh embodiment of the present invention, FIGS. 12A to 12C are top views for showing operation of the construction shown in FIG. 11, FIGS. 13A to 13C are top views for showing operation of a modification of the construction shown in FIG. 11, and FIGS. 14A and 14B are side views for showing operation of the eighth embodiment of the present invention.

DETAILED DESCRIPTION OF THE PREFERRED EMBODIMENTS

Figure 1:
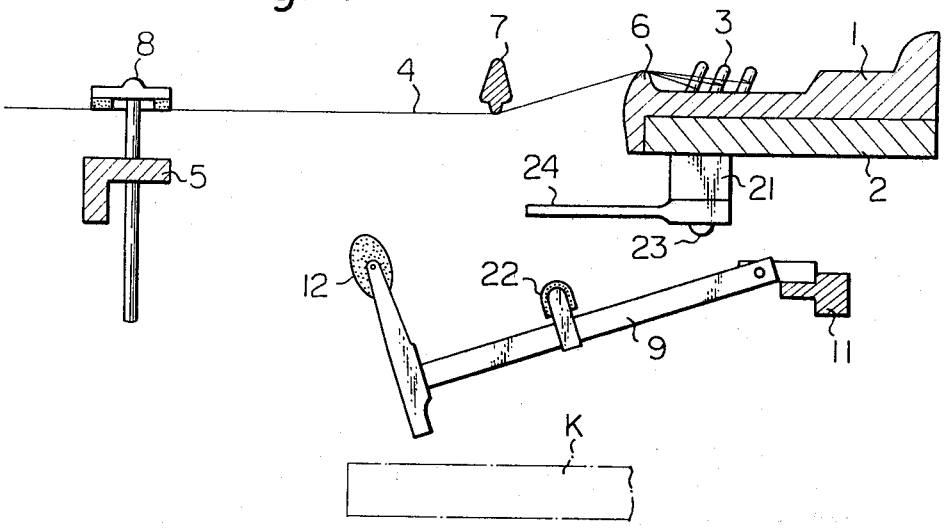
FIG. 1 is a side view, partly in section, of the first embodiment of the present invention.

Referring to FIG. 1, one embodiment of the improved keyboard musical instrument in accordance with the present invention is shown, in which the present invention is applied to an electric piano.

In the illustrated construction, a pin block 2 is disposed to the bottom of a piano frame 1 generally made of cast iron and a plurality of tuning pins 3 are securely arranged on the top face of the piano frame 1. A plurality of main elongated tone generators 4, i.e. strings in the case of the illustrated embodiment, are stretched between the tuning pins 3 and hitch pins which are not shown in the illustration and which are arranged on the piano frame 1 at positions distant from those of the tuning pins. The vibration of the strings 4 is converted into an electric signal by suitable transducers (not shown). The strings 4 are stretched while pressing astride a crest 6 of the piano frame 1 and the effective vibratory area of the strings 4 is defined by a capodustro bar 7 and bridge pins (not shown). A damper 8 guided by a damper guide rail 5 is arranged in the above-described effective tonal vibratory area and is operationally related to an associated common key K. At a position somewhat below the piano frame 1, a hammer shank 9 is pivoted at one end to a fixed hammer shank rail 11 which extends transversely of the piano. The hammer shank 9 carries a hammer 12 at the free end thereof and is also operationally related to the associated key. Key action mechanism is the same as used in the ordinary piano and is omitted from the illustration.

In the illustrated disposition, the key is not yet played, the hammer 12 rests in the stand-by position remote from the string 4 and the damper 8 is placed in the operative position in pressure contact with the string 4. As the key is operated, the damper 8 is lifted in order to free the string 4 and, concurrently, the hammer shank 9 is swung upwardly about its pivot so that the hammer 12 strikes the string 4 for tonal vibration.

The above-described basic construction and operation are common to the conventional electric piano. In combination with the above-described basic construction, the present invention comprises an auxiliary tone generator 24 carried by a bracket 21 disposed to the bottom of the pin block 2 and an auxiliary hammer 22 disposed to the middle of the hammer shank 9.

Figure 3:
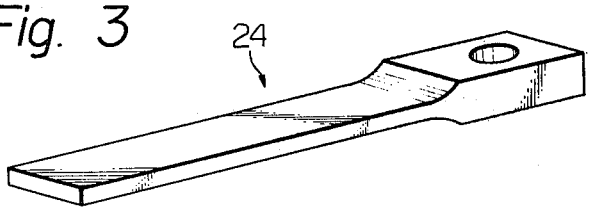
FIG. 3 is a perspective view of one example of the auxiliary tone generator used in the construction shown in FIG. 1, FIGS. 4A to 4C are side view, partly in section, for showing operation of the second embodiment of the present invention.

In the case of the illustrated embodiment, the auxiliary tone generator 24 is given in the form of a thin elongated metallic strap such as the one shown in FIG. 3. The auxiliary tone generator 24 is preferably mounted to the bracket 21 via a set screw 23 in a detachable fashion. The dimension of the construction is so designed that, when the main hammer 12 strikes the string 4, the auxiliary hammer 22 concurrently strikes the auxiliary tone generator 24. The vibration of the tone generator 24 is converted into an electric signal by a suitable transducer not shown.

As a substitute for the thin metal strap, a string may be used for the auxiliary tone generator 24. In this case, such a string may be stretched between associated pins, one of the pins being arranged on the piano frame and the other of the pins being arranged, e.g. on the damper guide rail 5.

While the auxiliary hammers 22 and tone generators 24 may be arranged for all the keys, they may more advantageously be arranged for keys in the middle and/or treble range. That is, provision of the auxiliary hammers 22 and tone generators 24 can be designed quite freely in accordance with requirement in the actual performance.

Figure 2:
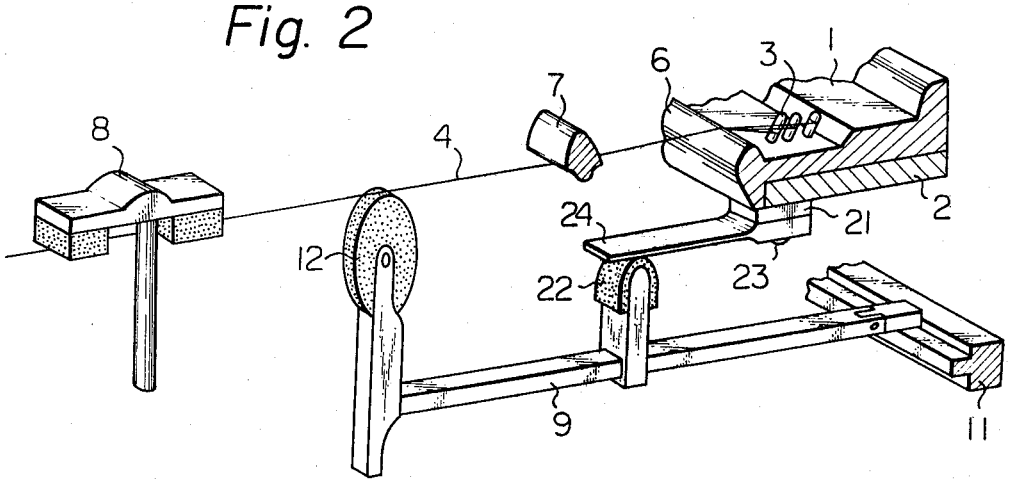
FIG. 2 is a perspective view of the construction shown in FIG. 1.

When a key associated with the above-described auxiliary elements is played, the hammer shank 9 is swing upwardly about its pivot, the main hammer 12 strikes the main tone generator 4, i.e. the string for tonal vibration and the auxiliary hammer 22 concurrently strikes the auxiliary tone generator 24, i.e. the metal strap, for simultaneous tonal vibration (see FIG. 2). As the key is detached, both hammers 12 and 22 return to the original stand-by positions away from the associated tone generators 4 and 24, the damper 8 presses the main tone generator 4 in order to restrain further tonal vibration and the auxiliary tone generator 24 sustains tonal vibration with damping.

As is clear from the foregoing description, operation on a single key in the keyboard musical instrument in accordance with the present invention causes simultaneous tonal vibrations of two different tone generators 4 and 24, i.e. the string and the metal strap and such simultaneous tonal vibrations generate a beautiful composite tone which is quite different in the tone colour from the tone to be generated by similar key operation on the conventional electric piano.

Figure 4A:
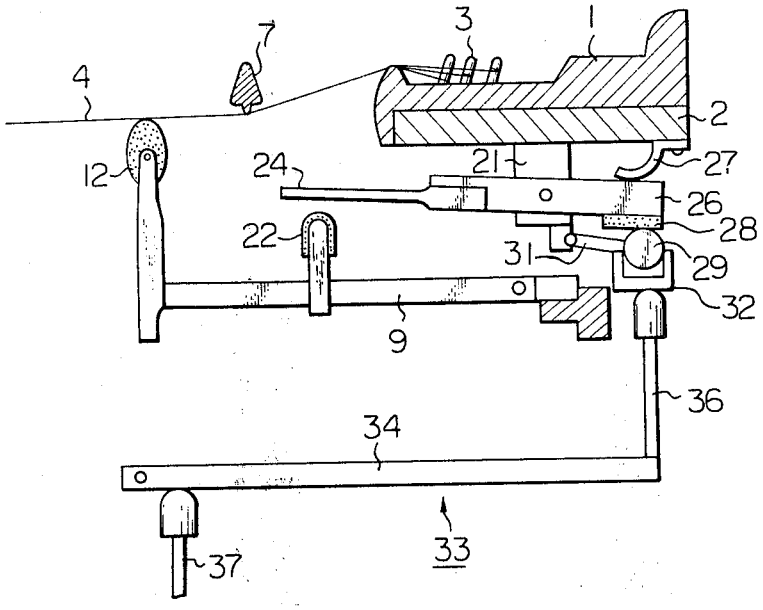
Figure 4B:
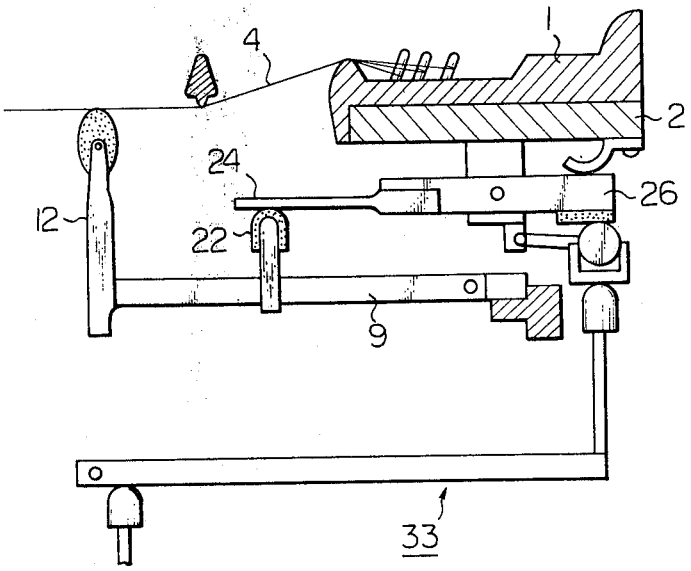
Figure 4C:
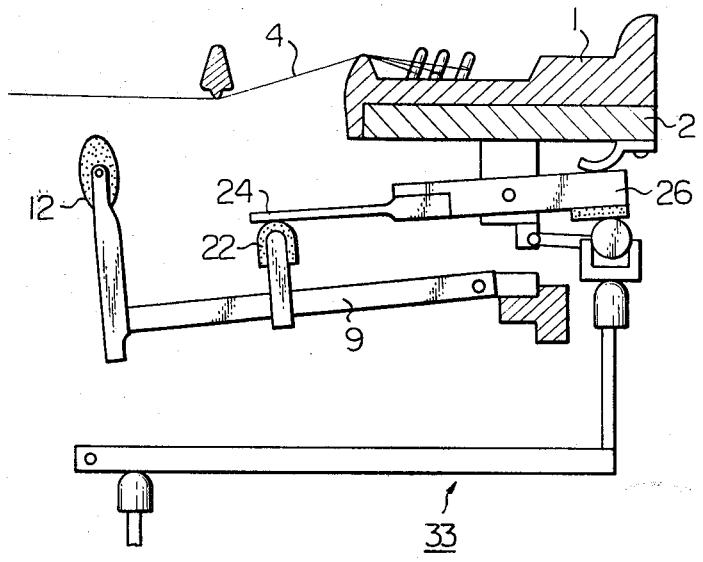

Another embodiment of the keyboard musical instrument in accordance with the present invention is shown in FIGS. 4A through 4C, in which like elements are designated with like reference numerals.

Like the foregoing embodiment, this construction is has a double hammers system and an auxiliary tone generator 24 in the form of a metal strap such as shown in FIG. 3. This tone generator 24 is fixedly mounted to one longitudinal end of a swingable rail 26 pivoted at the middle to the bottom bracket 21. A bent leaf spring 27 is fixed at one end (front end) to the bottom of the pin block 2 with the other end (rear end) in pressure contact with the top face of the other end of the rail 26 so that the rail 26 is always urged to turn clockwisely about the pivot in the drawing. A felt sheet 28 is bonded to the bottom of the rear end of the rail 26.

Figure 5:
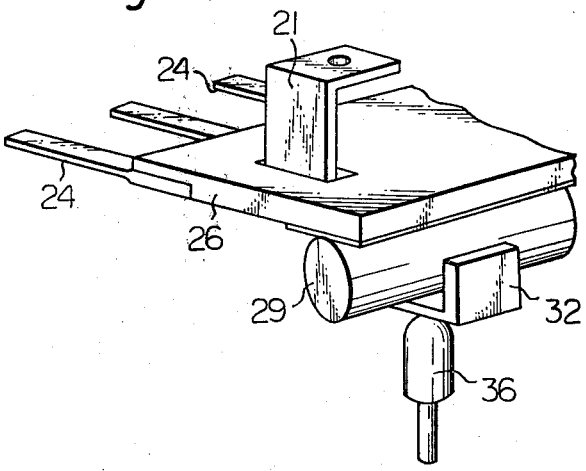
FIG. 5 is a perspective view of a portion of the construction shown in FIGS. 4A to 4C.

A rod 29 is arranged below the rear end of the rail 26 while being elongated in a direction crossing the string direction in contact with the felt sheet 28. This rod 29 is fixed to the rear end of a bar 31 which is pivoted at the front end to the bracket 21. As well seen in FIG. 5, a channel 32 is fixed to a longitudinal portion of the rod 29. This channel 32 is operationally related to a foot pedal of the electric piano via a link mechanism 33 which is substantially similar to the known piano pedal assembly. The link mechanism 33 includes a lever 34 pivoted at the front end and extending almost horizontally, a second pedal rod 36 fixed to the rear end of the lever 34 and a first pedal rod 37 operationally related to the pedal. The above-described channel 32 rests on the second pedal rod 36 and the lever 34 rests on the first pedal rod 37.

Relation in position between the auxiliary hammer 22 and the tone generator 24 varies in accordance with the stepin fashion of the foot pedal as follows.

In the disposition shown in FIG. 4A, the foot pedal is not stepped in. In this disposition, the auxiliary tone generator 24 is swung upwardly outside the moving ambit of the auxiliary hammer 22. In other words, the auxiliary hammer 22 is out of contact with the auxiliary tone generator 24 even when it has assumed the highest operative position with the main hammer 12 striking the main tone generator 4, i.e. the string.

In the disposition shown in FIG. 4B, the foot pedal has been stepped in over a depth half of its full stroke. The first pedal rod 37 lifts the lever 34, the second pedal rod 36 lifts the rear end of the rail 26 via the channel 32 and the rod 26 while compressing the leaf spring 27 and the auxiliary tone generator 24 lowers to a position to come in striking contact with the auxiliary hammer 22 in the highest operative position with the main hammer 12 striking the main tone generator 4, i.e. the string.

In the disposition shown in FIG. 4C, the foot pedal is stepped in over the full stroke thereof. The first pedal rod 37 further lifts the lever 34, the second pedal rod further lifts the rear end of the rail 26 and the auxiliary tone generator 24 further lowers to a position to come in striking contact with the auxiliary hammer 22 in the second highest operative position. Due to this contact, further upward swinging of the hammer shank 9 is hindered and the main hammer 12 cannot reach the highest operative position adapted for striking contact with the main tone generator 4, i.e. the string.

It is clear from the foregoing description, the construction assumes the disposition shown in FIG. 4A when the foot pedal is not stepped in. When the associated key is played under this disposition, the main hammer 12 strikes the main tone generator 4, i.e. the string, for tonal vibration, but the auxiliary hammer 22 does not strike the auxiliary tone generator 24. In this case, the tone to be generated is similar in tone colour to that obtained on the conventional electric piano.

The construction assumes the disposition shown in FIG. 4B when the foot pedal is stepped in over half of its full stroke. When the associated key is operated under this disposition, the main hammer 12 strikes the main tone generator 4, i.e. the string for tonal vibration, and, concurrently, the auxiliary hammer 22 also strikes the auxiliary tone generator 24, i.e. the metal strap. Such simultaneous tonal vibrations generates a beautiful composite tone whose tone colour is quite different from that of the tone to be generated by similar key operation on the conventional electric piano.

The construction assumes the disposition shown in FIG. 4C when the foot pedal is stepped in over its full stroke. When the key is operated under this disposition, the auxiliary hammer 22 strikes the auxiliary tone generator 24, i.e. the metal strap for tonal vibration, but the main hammer 12 does not strike the main tone generator 4, i.e. the string. The obtained tone is quite different in tone colour from those obtained under dispositions shown in FIGS. 4A and 4B.

Summary of the above-described tone mode selection is shown in Table 1 for the purpose of easy understanding.

TABLE 1

| Foot pedal step-in | Tone mode selection: Tonal vibration | Tone colour | Disposition |
|---|---|---|---|
| None | Main tone generator 4 | conventional | FIG. 4A |
| Half stroke | Main tone gererator 4<br>Auxiliary tone generator 24 | composite | FIG. 4B |
| Full stroke | Auxiliary tone generator 24 | different | FIG. 4C |

As is clear from the foregoing description, operation of the same key can selectively generate three tones of different tone colours when tactfully combined with concurrent operation on the foot pedal.

Like the foregoing embodiment, it is also employable in this embodiment to substitute a string for the metal strap used for the auxiliary tone generator 24.

It is also to be understood that, although the present invention is very advantageously applied to electric pianos, it can be employed in the construction of ordinary acoustic pianos.

Figure 6:
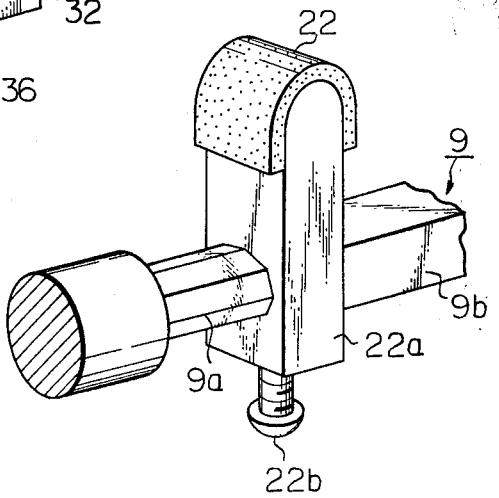
FIG. 6 is a perspective view for showing one example of the mounting of the auxiliary hammer to the hammer shank.

In the above-described constructions, it must be more advantageous if the auxiliary hammer can be easily replaceably mounted to the hammer shank so that different types of auxiliary hammers can be used for a similar auxiliary tone generator in order to obtain a variety of tonal effect. Such a variety of tonal effect can be obtained by adjusting the mounting position of the auxiliary hammer on the hammer shank. An example of the construction adapted for these purposes is shown in FIG. 6, in which the hammer shank 9 is provided with an angled longitudinal portion 9*a* having polygonal transverse cross sectional profile. The hammer wood 22*a* of the auxiliary hammer 22 is slidably inserted over the angled longitudinal portion 9*a* and registered at a selected position by fastening a set screw 22*b*. The rear end of the angled longitudinal portion 9*a* is axially and snugly inserted into the front end of the remaining portion 9*b* of the hammer shank 9. By loosening the set screw 22*b*, the mounting position of the auxiliary hammer 22 can be changed as desired without disturbing its angular posture about the axis of the hammer shank 9 due to the angled contour of the latter. When the auxiliary hammer 22 is to be replaced, the axial coupling between the two portions 9*a* and 9*b* is cancelled for easy removal of the used auxiliary hammer and attachment of the new auxiliary hammer.

In the case of the foregoing embodiments, two sets of tone generators are used in combination with two sets of corresponding hammers and, in the construction shown in FIGS. 4A through 4C, one of the two hammers may be selectively held inoperative by additionally employing foot pedal operation for generation of a variety of tones of different tone colours.

Figure 7A:
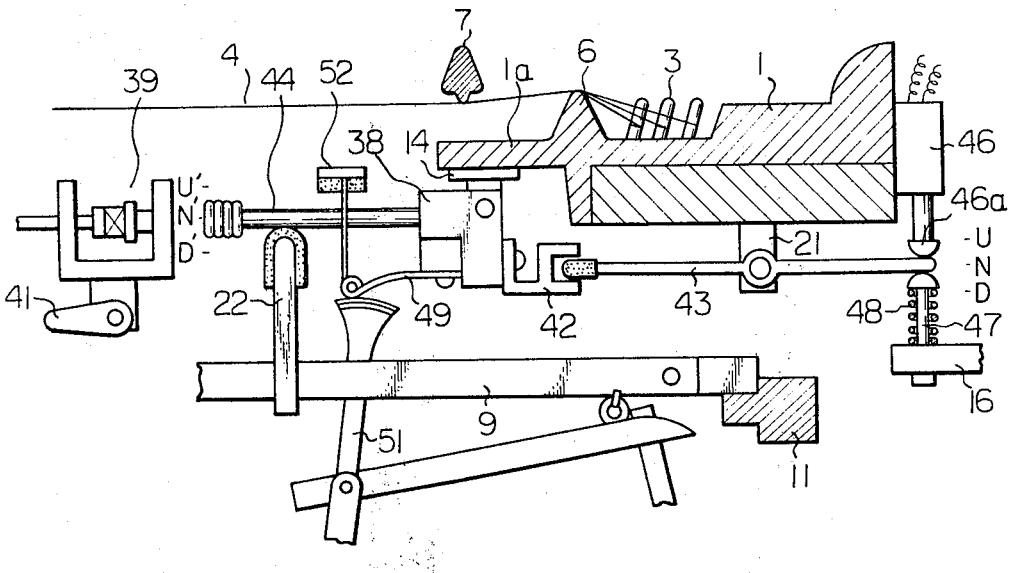
FIGS. 7A and 7B are side sectional and partly omitted perspective view of the third embodiment of the present invention.
Figure 7B:
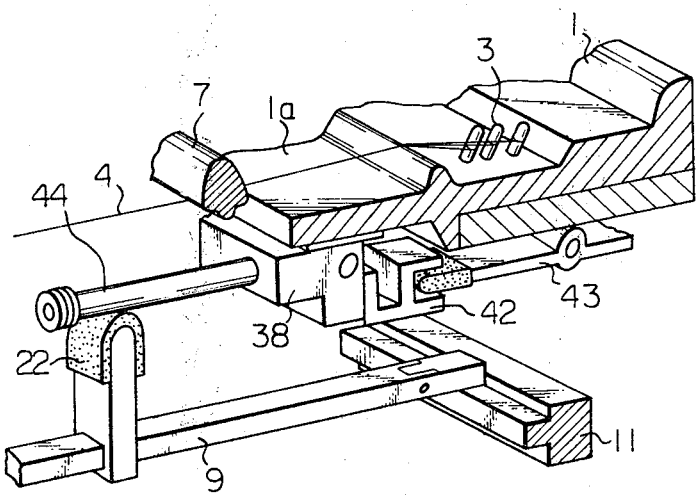

Referring to FIGS. 7A and 7B, there is shown the other embodiment of the keyboard musical instrument in accordance with the present invention, in which the present invention is applied to the construction of an electric piano, also. In this case, the construction is provided with two hammers 12 and 22, the main hammer 12 being omitted in the illustration for the purpose of simplification but being secured to the front end of the shank 9, and two tone generators 4 and 44. These two hammers 12 and 22 are swingably operated by a common playing key. Like elements are designated with like reference numerals.

Just like the foregoing embodiment, the main tone generator 12 takes the form of a string. The auxiliary tone generator 44 is given in the form of a wire rod of magnetic material. The piano frame 1 is provided with a front extension 1*a* which is associated with a bottom bracket 14 to which a holder block 38 is pivoted with the pivotal axis crossing the strings direction. The above-described auxiliary tone generator 44, i.e. the wire rod, is fixed to the front face of this holder block 38 and extends forwardly along the strings direction. An electromagnetic pickup 39 is arranged while confronting the front end of the auxiliary tone generator 44 in order to pick up the later described tonal vibration of the auxiliary tone generator 44 when it is struck by the auxiliary tone generator 44. The pickup 39 is electrically coupled by lead wires (not shown) to the electric system of the electric piano. The pickup 39 is associated with a stopper 41 turnably disposed to the bottom thereof in order to bar upward swinging of the hammer shank 9 when the main hammer 12 should not strike the main tone generator 4 as hereinafter described in more detail. The holder block 38 further carries a channel 42 fixed to the rear face thereof.

A swingable lever 43 is pivoted about the middle thereof to the bracket 21 fixed to the bottom of the pin block 2. The front end of the lever 43 operationally engages with the rear groove of the above-described channel 42. An electromagnetic solenoid 46 is mounted to the back face of the piano frame 1 and an operational terminal 46*a* of the solenoid 46 is in contact with the top face of the rear end of the lever 43. A pusher rod 47 is slidably held by a fixed block 16 while being urged by an associated spring 48 to push up the rear end of the lever 43. A V-shaped spring 49 is mounted at the apex thereof atop a bar 51 operationally related to the key via the action assembly. One end of the spring 49 is fixed to the front bottom of the holder block 38 and the other end of the spring 49 holds a damper 52 for the auxiliary tone generator 44.

The solenoid 46 is set to three conditions. In the first condition, the operational terminal 46*a* is registered at an up-position U, at a neutral position N in the second condition and at a down-position D in the third condition.

When the solenoid 46 is set to the second condition, the operational terminal 46*a* assumes the neutral position N and the lever 43 lies almost horizontally. Dimension of the construction is designed so that the auxiliary tone generator 44 comes in striking contact for tonal vibration with the auxiliary hammer 22 at the highest position, the key being operated and the main hammer 12 striking the main tone generator 4. This position of the auxiliary tone generator 44 is hereinafter named as a neutral position N′ which corresponds to the neutral position N of the solenoid operational terminal 46*a*.

When the solenoid 46 is set to the first condition the operational terminal 46a is brought to the up-position U. Then, the pusher rod 47 lifts the rear end of the lever 43 due to the repulsion of the spring 48 so that the lever swings counterclockwise in the drawing about the pivotal support. This causes associated clockwise turning of the holder block 38 about the pivotal support and the auxiliary tone generator 44 assumes an up-position U' which is higher than the neutral position N' and corresponds to the up-position U of the solenoid operational terminal 46a. At this up-position U', the auxiliary tone generator 44 is brought out of the operational terminal of the auxiliary hammer 22. Thus, the auxiliary hammer 22 does not strike the auxiliary tone generator 44 even when same assumes the highest position, the key being operated and the main hammer striking the main tone generator 4, i.e. the string for tonal vibration.

When the solenoid is set to the third condition, the operational terminal 46a is registered at the down-position D overcoming the repulsion of the spring 48. Then, the solenoid operational terminal 46a presses down the rear end of the lever 43 so that the latter swings clockwisely in the drawing about the pivotal support. This causes corresponding counterclockwise turning of the holder block 38 about the pivotal support and the auxiliary tone generator 44 assumes a down-position D' which is lower than the neutral position N' and corresponds to the down-position D of the solenoid operational terminal 46a. When the auxiliary tone generator 44 is at this down-position D', the auxiliary hammer 22 comes in striking contact for tonal vibration with the auxiliary tone generator 44 at the second highest position and further upward swinging of the hammer shank 9 about the pivotal support is restrained by this striking contact. Thus, the main hammer 12 cannot strike the main tone generator 4, i.e. the string, even when the key is operated.

When the solenoid 46 is set to the first condition and the solenoid operation terminal 46a is set to the up-position U, the tone to be generated is similar in tone colour to that obtained by similar key operation on the conventional electric piano. When the solenoid 46 is set to the second condition and solenoid operation terminal 46a is set to the neutral position N, a beautiful composite tone is generated whose tone colour is quite different from that of the tone to be generated by similar key operation of the conventional electric piano. When the solenoid 46 is set to the third condition and the solenoid operational terminal 46a assumes the down-position D, the tone to be generated is quite different in tone colour from those obtained with the first and second conditions of the solenoid 46.

Summary of the above-described tone mode selection is shown in Table 2 for better and simpler understanding.

TABLE 2

| | Tone mode selection | |
|---|---|---|
| Solenoid | Tonal vibration | Tone colour |
| First condition | Main tone generator 4 | conventional |
| Second condition | Main tone generator 4<br>Auxiliary tone generator 44 | composite |
| Third condition | Auxiliary tone generator 44 | different |

When the electric piano is to be played with the solenoid 46 being in the third condition only, it is advantageous to turn the stopper 41 into the vertical posture so that the free end thereof effectively hinders inertia lifting, upward swinging, of the hammer shank 9 at the striking contact of the auxiliary hammer 22 with the auxiliary tone generator 44.

Condition of the solenoid 46 can be controlled freely by manually operating a knob, dial or button provided on the keyboard of the electric piano.

Figure 8:
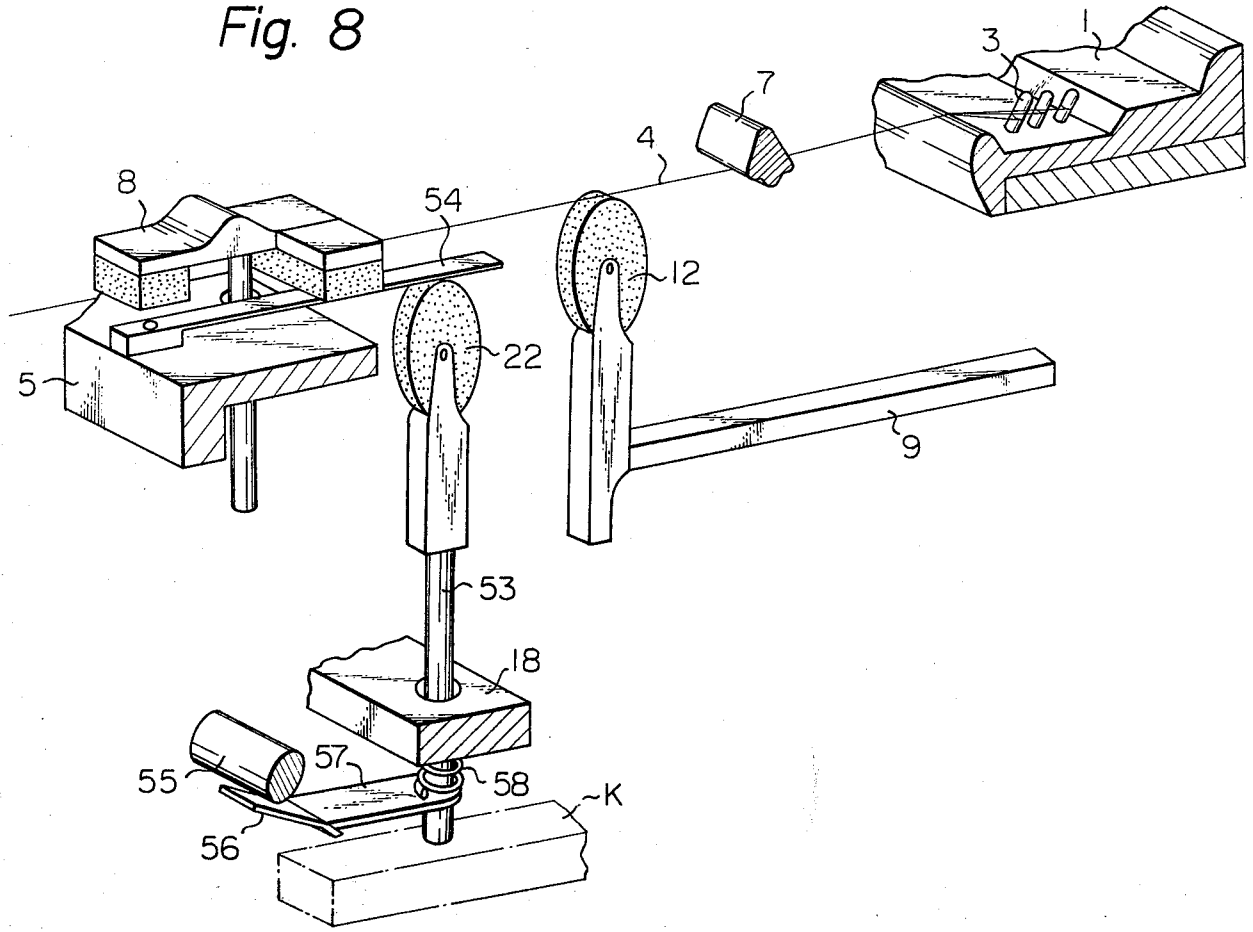
FIG. 8 is a perspective view of the fourth embodiment of the present invention.

The other embodiment of the keyboard musical instrument in accordance with the present invention is shown in FIG. 8, in which like elements are designated with like reference numerals. Although two sets of hammers 12 and 22 are used in this embodiment, movement of the auxiliary hammer 22 is caused by a common key K which is used for the swing of the main hammer 12. As in the foregoing embodiments, the main hammer 12 is carried by the hammer shank 9 and strikes the main tone generator 4, i.e. the string, for tonal vibration every time when the associated key is operated just like on the conventional electric pianos. A guide rail 18 is arranged under the damper wire guide rail 5 while extending across the strings direction in order to slidably guide a vertical rod 53 which is operationally related at the lower end to the associated key K. The auxiliary hammer 22 is disposed atop the vertical rod 53. A control shaft 55 is arranged in parallel to the guide rail 18, which securely carries a lifter tongue 56. The vertical rod 53 is provided with a stopper 57 fixed thereto below the guide rail 18 and a compression spring 58 is inserted between the guide rail 18 and the stopper 57. Outer end of the stopper 57 slightly rests on the lifter tongue 56 when the key K is not operated.

The auxiliary tone generator 54 in this embodiment takes the form of an elongated thin metal strap which is detachably mounted on the damper wire guide rail 17 and extends rearwardly towards the main hammer 12. The control shaft 55 is axially turnable by manually operating a suitable control knob (not shown) arranged on the electric piano. The damper 8 in this embodiment is so designed that it is operative on the auxiliary tone generator 54 when the key K is not operated. When the control shaft 55 is turned counterclockwise in the drawing, the lifter tongue 56 swings upwardly in order to lift the stopper 57, thereby lifting the vertical rod 53 out of the influence of the associated key operation.

In the case of this embodiment, two different tonal modes can be obtained selectively. In the case of the first tonal mode, the vertical rod 53 is placed under influence of the key operation. As the associated key is operated, the main hammer 12 strikes the main tone generator 4, i.e. the string, for tonal vibration and the auxiliary hammer 22 strikes the auxiliary tone generator 54 for tonal vibration. This simultaneous striking of the tone generators 4 and 54 generates a beautiful composite tone whose tone colour is quite different from that of the tone to be generated by similar key operation on the conventional electric piano. In the case of the second tonal mode, the vertical rod 53 is placed out of the influence of the key operation. As the associated key is operated, the main hammer 12 strikes the main tone generator 4, i.e. the string, for tonal vibration, but the auxiliary hammer 22 does not strikes the auxiliary tone generator 54. Thus, the tone to be generated is similar in tone colour to that obtained by similar key operation on the conventional electric piano.

Summary of the above-described tone mode selection is shown in Table 3 for easier understanding.

TABLE 3

| Lifter tongue | Tone mode selection: Tonal vibration | Tone colour |
|---|---|---|
| Down | Main tone generator 4<br>Auxiliary tone generator 54 | composite |
| up | Main tone generator 4 | conventional |

Instead of the auxiliary tone generator 54 in the form of the metal strap, a string or the like may be used therefor while being properly stretched between the damper wire guide rail 5 and the piano frame 1.

In the case of the foregoing embodiments, two sets of tone generators are used in combination with two sets of hammers while different hammers strike different tone generators upon key operation.

Figure 9:
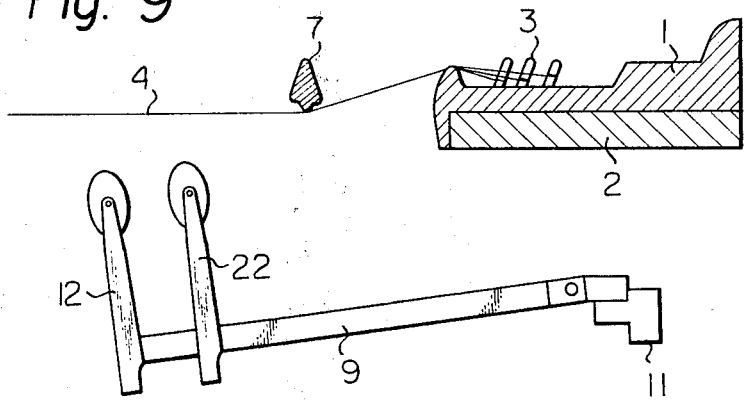
FIG. 9 is a side view, partly in section, of the fifth embodiment of the present invention.

A further embodiment of the keyboard musical instrument in accordance with the present invention is shown in FIG. 9, in which two sets of hammers are used in combination with a single tone generator, i.e. a string. In this embodiment, the main and auxiliary hammers 12 and 22 are mounted to the common hammer shank 9, the main hammer 12 being positioned at the front end of the hammer shank 9. That is, the mounting position of the main hammer 12 is the same as that of the hammer on the conventional electric piano.

When the key is operated, both hammers 12 and 22 strike the tone generator 4, i.e. the string, for tonal vibration concurrently but at different positions. In other words, the main hammer 12 strikes the tone generator 4, i.e. the string, for tonal vibration at a position similar to that on the conventional electric piano and the auxiliary hammer 22 strikes the tone generator for tonal vibration at a position somewhat closer to the tuning pins 3. Thus, a composite tone is generated which is quite different in tone colour from and richer in tone volume than that to be generated by similar key operation on the conventional electric piano.

In the case of the above-described embodiment, two sets of hammers 12 and 22 mounted on a common hammer shank 9 are used in combination with the single tone generator 4, i.e. the string. Thus, there is no possibility for selection of tone mode. While employing a basically similar system, the embodiment shown in FIG. 10 enables selection of tone mode by introducing a construction like the one shown in FIG. 8. Although two sets of hammers 12 and 22 are used in this embodiment, movement of the auxiliary hammer 22 is caused by a common key K which is used for the swing of the main hammer 12. The main hammer 12 is carried by the hammer shank 9 and strikes the main tone generator 4, i.e. the string, for tonal vibration every time when the associated key K is operated just like on the conventional electric piano.

A guide rail 18 is arranged under the tone generator 4, i.e. the string, while extending across the strings direction in order to slidably guide a vertical rod 53 which is operationally related at the lower end to the associated key K. The auxiliary hammer 22 is mounted atop the vertical rod 53. A control shaft 55 is arranged in parallel to the guide rail 18, and the shafts carries a lifter tongue 56. The vertical rod 53 is provided with a stopper 57 fixed thereto at a position below the guide rail 18 and a compression spring 58 is inserted between the guide rail 18 and the stopper 57. The outer end of the stopper 57 slightly rests on the lifter tongue 56 when the key K is not operated.

The control shaft 55 is axially turnable by manually operating a suitable control knob (not shown) arranged on the electric piano. When the control shaft 55 is turned counterclockwisely in the drawing, the lifter tongue 56 swings upwardly in order to lift the stopper 57, thereby lifting the vertical rod 53 out of the influence of the associated key operation.

In the case of this embodiment, two different tonal modes can be obtained selectively. In the case of the first tonal mode, the vertical rod 53 is placed under influence of the key operation. As the associated key is operated, the main hammer 12 strikes the tone generator 4, i.e. the string, at an ordinary position for tonal vibration and the auxiliary hammer 22 also strikes the tone generator 4 at a different position for tonal vibration. This simultaneous striking of a common tone generator at different positions enables generation of a beautiful composite tone whose tone colour is quite different from that of the tone to be generated by similar key operation on the conventional electric piano. In the case of the second tonal mode, the vertical rod 53 is placed out of the influence of the key operation. As the associated key is operated, the main hammer 12 strikes the tone generator 4, i.e. the string, for tonal vibration, but the auxiliary hammer 22 does not strike the tone generator 4. Thus, the tone to be generated is similar in tone colour to that obtained by similar key operation on the conventional electric piano. Summary of the above-described tone mode selection is substantially same as that shown in Table 3.

Figure 10:
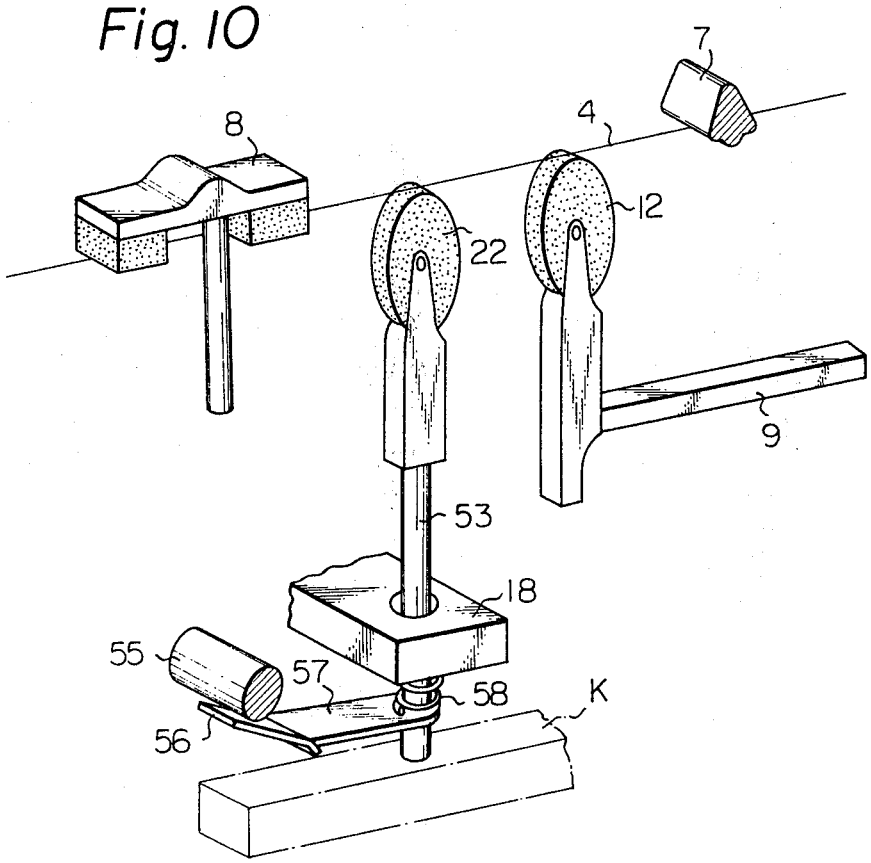
FIG. 10 is a perspective view of the sixth embodiment of the present invention.

In the case of the embodiments shown in FIGS. 9 and 10, two sets of hammers are used in combination with a single tone generator, i.e. a string. In a further modification of the keyboard musical instrument in accordance with the present invention, a single hammer may be used in combination with two sets of tone generators. FIG. 11 depicts a further embodiment of this type.

A hammer shank 59 is pivoted at one end to a hammer shank rail 19 and carries at the other end a hammer 62. The hammer shank rail 19 is operationally related to a foot pedal (not shown) via a suitable link mechanism (not shown) which is roughly similar in construction and function to the soft pedal assembly used on conventional grand type pianos. By foot operation on the foot pedal, the shank rail 19 is displaced in a direction across the strings direction together with the hammer 62. An auxiliary tone generator 64 is mounted on the front extension 1*a* of the piano frame 1 and extends in parallel to the main tone generator 4, i.e. the string. Although the auxiliary tone generator 64 in this embodiment takes the form of an elongated thin metal strap, same may be replaced by a string. A pressure sensitive element 61 such as a piezo-electric element is mounted on the auxiliary tone generator 64 and electrically coupled to an electric system of the electric piano.

FIGS. 12A through 12C depict the manner of tone mode selection with the above-described construction.

When the foot pedal is not stepped in, the hammer 62 assumes the position shown in FIG. 12A which is just below the main tone generator 4 only. As the key is operated under this disposition, the hammer 62 strikes the main tone generator 64 only for tonal vibration. Thus, the tone generated under this disposition is quite similar in tone colour to that to be generated by similar key operation on the conventional electric piano.

When the foot pedal is stepped in over a depth half of its full stroke, the hammer 62 assumes the position shown in FIG. 12B which is below the main and auxiliary tone generators 4 and 64. As the key is operated under this disposition, the hammer 62 strikes both tone generators 4 and 64 concurrently for tonal vibration. This simultaneous striking generated a beautiful composite tone which is far richer in tone colour and volume than that to be generated by similar key operation on the conventional electric piano.

When the foot pedal is stepped in over the full stroke, the hammer 62 assumes the position shown in FIG. 12C which is just below the auxiliary tone generator 64 only. As the key is operated under this disposition, the hammer 62 strikes the auxiliary tone generator 64 only for tonal vibration. Therefore, the tone generated under this disposition is quite different in tone colour from that to be generated by similar key operation on the conventional electric piano.

Summary of the above-described tone mode selection is shown in Table 4 for easier understanding.

TABLE 4

| Foot pedal step-in | Tonal vibration | Tone colour | Disposition |
|---|---|---|---|
| | Tone mode selection | | |
| None | Main tone generator 4 | conventional | FIG. 12A |
| Half stroke | Main tone generator 4<br>Auxiliary tone generator 64 | composite | FIG. 12B |
| Full stroke | Auxiliary tone generator 64 | different | FIG. 12C |

As hereinbefore discribed, the present invention is most advantageously applicable to the treble and middle tone ranges of electric pianos in which three sets of strings as main tone generators are generally used in combination for a single tone. When the present invention is employed, one of the three main tone generators is replaced by on auxiliary tone generator. In the embodiment shown in FIGS. 13A through 13C, two sets of main tone generators **4*a* and 4*b*, i.e. strings, are used in combination with an auxiliary tone generator 64** for a single tone. Selection of tone mode is carried out, for example, in the following fashion.

When the foot pedal is not stepped in, the hammer 62 assumes a position shown in FIG. 13A which is just below the main tone generators **4*a* and 4*b* only. As the key is operated under this disposition, the hammer 62 strikes the main tone generators 4*a* and 4*b*** only for tonal vibration. Thus, the tone generated under this disposition is a little different in tone colour and volume from that to be generated by similar key opertion on the conventional electric piano due to absence of one main tone generator.

When the foot pedal is stepped in over a depth half of its full stroke, the hammer 62 assumes the position shown in FIG. 13B which is below one of the main tone generator **4*a* and the auxiliary tone generator 64. As the key is operated under this deposition, the hammer 62 strikes both tone generators 4*a* and 64** concurrently for tonal vibration. This simultaneous siriking generates a beautiful composite tone which is far richer in tone colour and volume than that to be generated by similar key operation on the conventional electric piano.

When the foot pedal is stepped in over the full stroke, the hammer 62 assumes the position shown in FIG. 13C which is just below the auxiliary tone generator 64 only. As the key is operated under this disposition, the hammer 62 strikes the auxiliary tone generator only for tonal vibration. Thus, the tone generated under this disposition is quite different in tone colour from that to be generated by similar key operation on the conventional electric piano.

Summary of the above-described tone mode selection is shown in Table 5 for better understanding.

TABLE 5

Figure 13A:
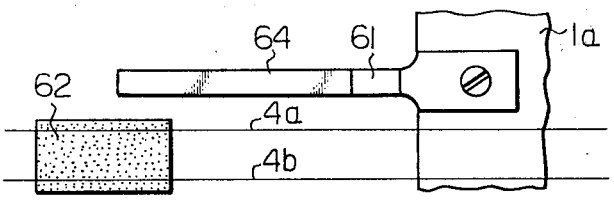
Figure 13B:
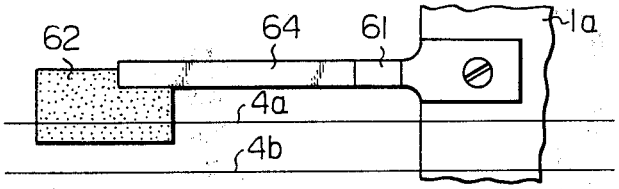
Figure 13C:
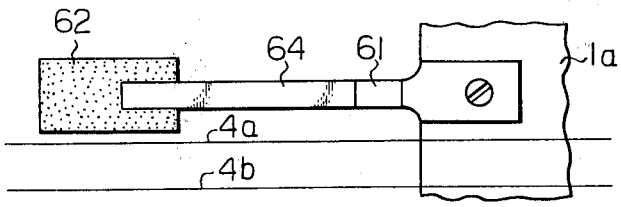

| Foot pedal step-in | Tonal vibration | Tone colour | Disposition |
|---|---|---|---|
| | Tone mode selection | | |
| None | Main tone generators 4a, 4b | a litte different | FIG. 13A |
| Half stroke | Main tone generator 4a<br>Auxiliary tone generator 64 | composite | FIG. 13B |
| Full stroke | Auxiliary tone generator 64 | different | FIG. 13C |

Figure 14A:
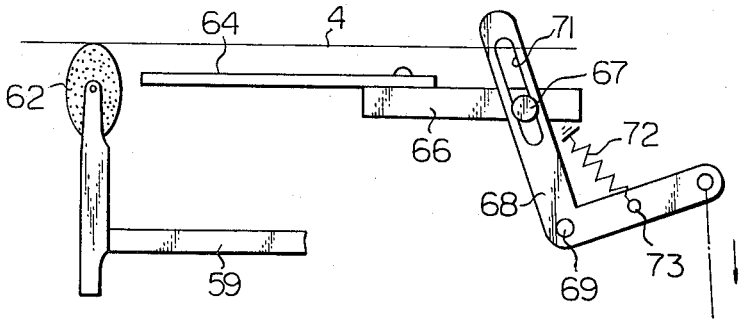
Figure 14B:
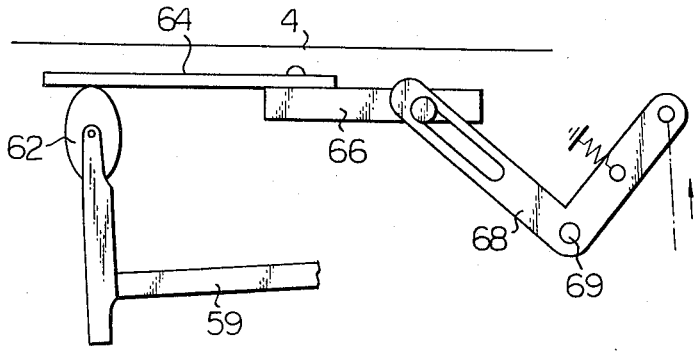

In the case of the construction shown in FIGS. 12A through 12C and 13A through 13C, the tone generators are mounted immovably and the hammer 62 is arranged movably with respect to the tone generators in a direction crossing the strings derection for the purpose of tone mode selection. Inversely, it is also employable in the present invention that the auxiliary tone generator 62 should be arranged movably with respect to the main tone generator 4 and the hammer 62 for the purpose of tone mode selection. An embodiment of the present invention of this type is shown in FIG. 14A and 14B, in which, like the foregoing embodiment, a hammer 62 is pivoted via a hammer shank 59 to a given hammer shank rail 19 (not shown). An auxiliary tone generator 64 in the form of an elongated thin metal strap is arranged somewhat below the main tone generator 4, i.e. the string, while being carried by a rail 66 which is displaceable in the strings direction and provided with a side pin 67. An L-shaped lever 68 is pivoted at the apex to a fixed pin 69 arranged below the movable rail 66. A slot 71 is formed in one branch of the lever 68 in which the above-described side pin 67 of the rail 66 is idly received. The rear end of the other branch of the lever 68 is operationally related to the foot pedal via a suitable link mechanism (not shown). A spring 72 is inserted between a fixed support and a side pin 73 on the lever 68 in order to urge the lever 68 to turn clockwise in the drawing.

For effecting tone mode selection, it is assumed that the construction should be placed under the disposition shown in FIG. 14A when the foot pedal is not operated. In this disposition, the auxiliary tone generator 64 is placed out of the moving ambit of the hammer 62. As the associated key is operated, the hammer 62 strikes the main tone generator 4 for tonal vibration. Thus, the tone generated by this striking is similar in tone colour to that to be generated by similar key operation on the conventional electric piano.

When the foot pedal is stepped in, the lever 68 is urged to turn counterclockwise in the drawing about its pivotal support and the construction assumes the disposition shown in FIG. 14B, in which the auxiliary tone generator 64 is now placed in the operation ambit of the hammer 62 at a level somewhat below the main tone generator 4, i.e. the string. As the associated key is operated under this disposition, the hammer 62 strikes the auxiliary tone generator 64 for tonal vibration. This striking contact between the two elements 62 and 64 restrains further upward swinging of the hammer shank 59 and, therefore, the hammer 62 naturally does not strike the main tone generator 4. Therefore, the tone generated under this disposition is quite different in tone colour from that to be obtained by similar key operation on the conventional electric piano.

Summary of the above-described tone mode selection is shown in Table 6 for better understanding.

TABLE 6

| Tone mode selection | | | |
|---|---|---|---|
| Foot pedal step-in | Tonal vibration | Tone colour | Disposition |
| None | Main tone generator 4 | conventional | FIG. 14A |
| Stepped in | Auxiliary tone generator 64 | different | FIG. 14B |

Although the foregoing description is mostly focussed upon application of the present invention to electric pianos, it should be understood that the present invention is advantageously applicable to ordinary acoustic pianos with immaterial modifications.

As is clear from the foregoing description, the present invention contemplates generation of a variety of tones by single key operation which are similar to, richer than or different in tone colour and volume from the tone to be generated by similar key operation on the conventional pianos. Though introduction of additional foot pedal, dial, button and for knob operation or operations, a wide variety of freedom can be obtained in tone mode selection in accordance with requirement in actual performance.

In the illustrations, transducing means for converting vibrations of tone generators into electric signals are omitted for simplicity except for the tone generator 44 in FIG. 7A and for the tone generation 64 in FIG. 11.

I claim:

1. Improved keyboard musical instrument comprising:

a main vibratory tone generator arranged on said instrument;

an auxiliary vibratory tone generator arranged on said instrument separately from said main tone generator;

a main hammer mounted on a swingable hammer shank for striking said main tone generator for tonal vibration of said main tone generator;

an auxiliary hammer mounted on said swingable hammer shank for striking said auxiliary tone generator for tonal vibration of said auxiliary tone generator;

means for operationally coupling said hammer shank to an associated key, whereby operating the key swings said hammer shank and means for selectively displacing said auxiliary tone generator to any of three different positions so that only said main hammer is allowed to strike said main tone generator when said auxiliary tone generator assumes a first one of said three positions, said main and auxiliary hammers are allowed to strike said respective main and auxiliary tone generators when said auxiliary tone generator assumes a second one of said three positions, and only said auxiliary hammer is allowed to strike said auxiliary tone generator when said auxiliary tone generator assumes a third one of said three positions.

2. Improved keyboard musical instrument as claimed in claim 1 in which said displacing means includes a swingable rail pivoted to said instrument and carrying said auxiliary tone generator at one end thereof, and a link mechanism operationally coupling the other end of said swingable rail to a foot pedal.

3. Improved keyboard musical instrument as claimed in claim 2 in which the step-in depth of said foot pedal is adjustable into three different stages in accordance with said three different positions to be assumed by said auxiliary tone generators.

4. Improved keyboard musical instrument as claimed in claim 1 in which said displacing means includes a holder block pivoted to said instrument and carrying said auxiliary tone generator at the front face thereof a swingable lever pivoted at the middle to said instrument and having one end operationally coupled to said holder block, an electro-magnetic solenoid operationally coupled to the other end of said swingable lever, means resiliently urging said the other end of said swingable rail to move against force applied by said solenoid, and an adjuster element for setting said solenoid to three different conditions in accordance with said three different positions to be assumed by said auxiliary tone generator.

5. Improved keyboard musical instrument as claimed in claim 1 in which said auxiliary tone generator takes the form of an elongated thin metal strap.

6. Improved keyboard musical instrument as claimed in claim 1 in which said auxiliary tone generator takes the form of a wire rod.

7. Improved keyboard musical instrument comprising:

a main vibratory tone generator arranged on said instrument;

an auxiliary vibratory tone generator arranged on said instrument separately from said main tone generator;

a main hammer mounted on a swingable hammer shank to strike said main tone generator for tonal vibration of said main tone generator;

a vertical rod which is movable vertically; an auxiliary hammer mounted atop said vertical road for being moved by said vertical rod to strike said auxiliary tone generator for tonal vibration of said auxiliary tone generator;

means for operationally and separately coupling said hammer shank and said vertical rod to a common associated key; said key being movable; said coupling means translating movement of said key into vertical movement of said rod; and means for selectively displacing said vertical rod to two different positions so that said main and auxiliary hammers are both driven for striking the respective said main and auxiliary tone generators when said vertical rod assumes a first one of said two positions, and only said main hammer is driven for striking said main tone generator when said vertical rod assumes a second one of said two positions.

8. Improved keyboard musical instrument as claimed in claim 7 in which said displacing means includes a stopper fixed to said vertical rod, means for resiliently urging said stopper to move said vertical rod towards said first position, a swingable tongue on which said stopper rests, and means for swinging said tongue to move said vertical rod towards said second position via said stopper against force by said resilient urging means.

9. Improved keyboard musical instrument as claimed in claim 7 in which said auxiliary tone generator takes the form of a string stretched on said instrument.

10. Improved keyboard musical instrument as claimed in claim 7 in which said auxiliary tone generator takes the form of an elongated thin metal strip fixed at one end to said instrument.

11. Improved keyboard musical instrument as claimed in claim 7 in which said auxiliary tone generator takes the form of an wire rod fixed at one end.

* * * * *